United States Patent [19]

Pinckney

[11] 4,051,838

[45] Oct. 4, 1977

[54] OVEN RACK

[76] Inventor: Cheryl Pinckney, 60 Magnolia Ave., Mount Vernon, N.Y. 10553

[21] Appl. No.: 680,855

[22] Filed: Apr. 27, 1976

[51] Int. Cl.[2] ..... F21C 15/16

[52] U.S. Cl. ..... 126/340; 312/273

[58] Field of Search ..... 126/339, 340, 41 D; 312/328, 330 R, 216, 217, 273

[56] References Cited

U.S. PATENT DOCUMENTS

| | | | |
|---|---|---|---|
| 681,309 | 8/1901 | Gentle | 126/339 |
| 1,501,456 | 7/1924 | Jirasek | 126/339 |
| 1,961,332 | 6/1934 | Burch et al. | 126/41 D |
| 2,116,854 | 5/1938 | Teller et al. | 126/339 X |

*Primary Examiner*—Edward G. Favors

*Attorney, Agent, or Firm*—Allen D. Brufsky

[57] ABSTRACT

An oven having a slidable rack. A handle is connected to the rack and projects exteriorly of the oven for movement in an elongated slot in an oven side wall. Movement of the handle in the slot will enable the rack to be slid into and out of the oven chamber without touching the rack. Cooperating pins on the rack and the oven cover pivot the cover to an open position as the rack is slid forwardly by its handle to a stop position wherein the pins return to an abutting relationship to limit further movement of the rack.

2 Claims, 3 Drawing Figures

OVEN RACK

BACKGROUND OF THE INVENTION

This invention relates to an oven and more particularly, a slidable rack construction for such an oven.

Ovens are provided with wire racks for supporting pans, trays, casseroles and other cooking utensils. The rack is usually slidably mounted upon pins, projections, or rails, provided on the inner walls of the oven chamber. Frequently, it is necessary for a housewife to remove the food being cooked from the oven for inspection, basting, turning, and the like or to remove the rack for cleaning. During this operation, the rack is extremely hot so that before pulling it forward to vender the food accessible, a housewife must first locate a pot holder, towel, gloves or the like or run the risk of being burned if she touches the rack with her bare hands.

SUMMARY OF THE INVENTION

Accordingly, this invention relates to a slidable oven rack having an insulated handle which extends exteriorly from the oven wall. In order to remove the rack for access to the food being cooked, the user slides the handle towards the front of the oven in a slot formed in the oven wall. The rack moves forwardly and a push pin on the front of the rack contacts a kick pin mounted on a bracket on the oven cover to pivot the cover open in one operation. The abuttment of the push pin and kick pin when the cover is opened provides a stop for forward movement of the rack enabling the user access to the food on the rack. When the cover is closed, the neck pin, via its contact with the push pin, slides the neck back into the oven chamber. In this manner, the user need not touch or come into contact with the hot rack.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
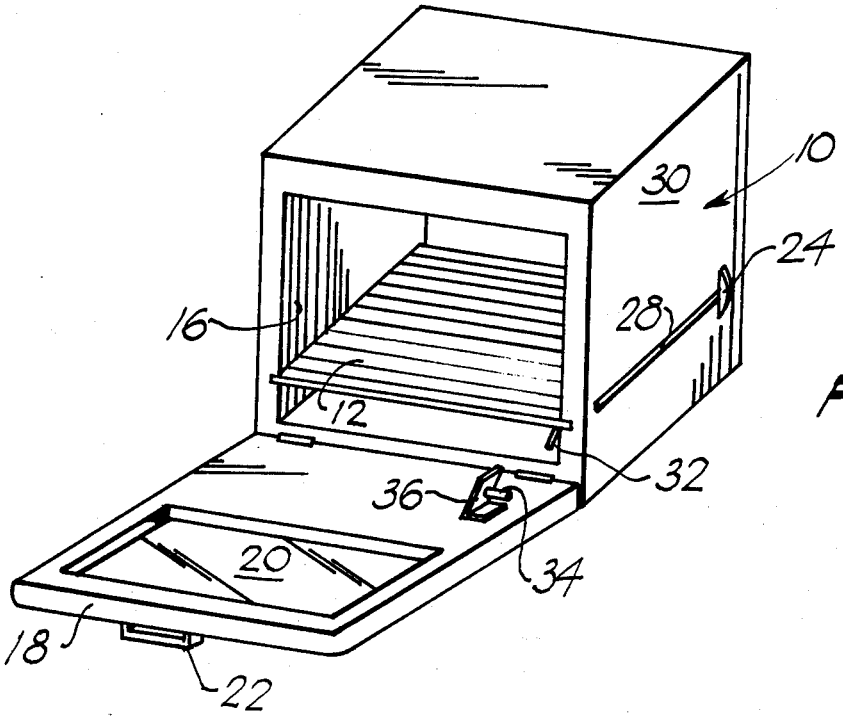
FIG. 1 is a perspective view of an oven having a slidable rack construction of the present invention.
Figure 2:
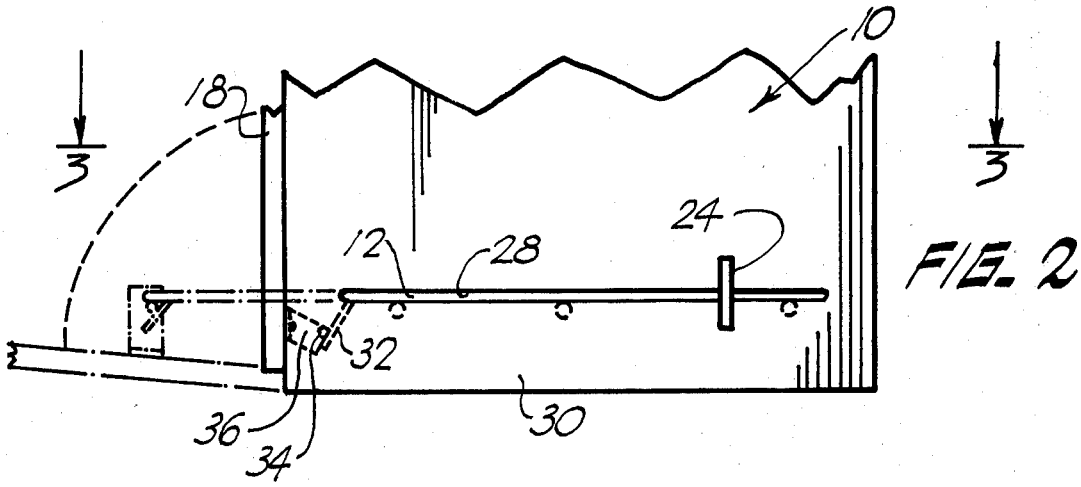
FIG. 2 is a partial side view in elevation of the oven of FIG. 1, illustrating in phantom lines the movement of the rack.
Figure 3:
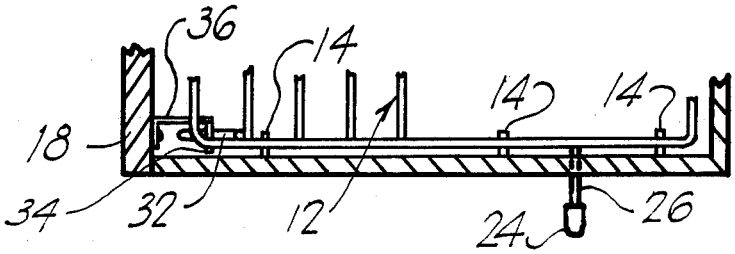
FIG. 3 is a partial cross-sectional view taken substantially along the plane indicated by line 3—3 of FIG. 2.

Referring now to the drawing in detail, wherein like numerals indicate like elements throughout the several views, a toaster or microwave oven 10 is shown in FIG. 1.

Oven 10 has a rack 12 slidably mounted on rack support pins 14 provided on the opposite walls of oven chamber 16. A door 18 is hinged to the front of oven 10 to close oven chamber 16 and includes a window 20 for observing the food being cooked within chamber 16 and a handle 22 for opening and closing door 18.

Rack 12 has an insulated handle 24 connected to it by a shaft 26. Handle 24 extends through an elongated slot 28 in a side wall 30 of oven 10. In order to move the rack 12 for access to the food being cooked within oven, the user slides the handle 24 towards cover 18 in slot 28.

A push pin 32 extending downwardly from the front of rack 12 contacts a kick pin 34 mounted on an angle bracket 36 on oven cover 18 to pivot door 18 open about its hinges as the rack 12 is slid forwardly. The abutment of push pin 32 with kick pin 34 when cover 18 is opened, as shown in FIG. 1, provides a stop for forward movement of rack 12, enabling the user to have access to the food on the rack.

When cover 18 is closed by pushing handle 22 upwardly, kick pin 34 via its contact with push pin 32 slides rack 12 back into oven chamber 16.

In the foregoing manner, the user need not touch or come into contact with the hot rack 12.

It should also be apparent that more than one rack 12 could be provided in oven chamber 16 with a handle 24 for sliding it in the same manner as described, cooperating with a second door 18 of desired.

I claim:

1. An oven comprising:

an oven chamber having a side wall, at least one rack slidably mounted in said oven chamber, an elongated slot in said side wall, a handle connected said rack extending through said sidewall and slidable within said elongated slot to slide said rack into and out of said oven chamber, a cover pivotally mounted on said oven adapted to close said oven chamber, and cooperating means mounted on said rack and cover for pivoting said cover to open said oven chamber in response to said rack being slid out of said oven chamber, said cooperating means including:

a downwardly extending push pin fixed to said rack, and a bracket on said cover having a kick pin in abutment with said push pin when said rack is fully housed within said oven chamber and when said rack is at its furthermost extension out of said oven chamber in which position said kickpin serves as a stop restraining further movement of said rack.

2. An oven in accordance with claim 1 wherein said cover includes a handle whereby a said oven chamber can be opened and closed independent of said cooperating means, and when closed, said kickpin can push said push pin and rack back into a housed position within said oven chamber.

* * * * *